United States Patent [19]

Takagi et al.

[11] Patent Number: 4,480,764

Date of Patent: Nov. 6, 1984

[54] DRINKING CUP STORAGE AND FEEDING DEVICE FOR AN AUTOMATIC VENDING MACHINE

[75] Inventors: Toshio Takagi, Kuwana; Masao Iwanami, Suzuka; Teruaki Sumikawa, Yokkaichi, all of Japan

[73] Assignee: Fuji Electric Company, Ltd., Kawasaki, Japan

[21] Appl. No.: 466,292

[22] Filed: Feb. 14, 1983

[30] Foreign Application Priority Data

Feb. 18, 1982 [JP] Japan ..... 57-24931

[51] Int. Cl.[3] ..... G07F 11/12

[52] U.S. Cl. ..... 221/11; 221/106; 221/119; 221/252

[58] Field of Search ..... 221/10, 11, 103–106, 221/119, 132, 252

[56] References Cited

U.S. PATENT DOCUMENTS

| | | | |
|---|---|---|---|
| 2,352,858 | 7/1944 | Nicholson | 221/11 |
| 3,075,480 | 1/1963 | Berg | 221/11 |
| 3,506,156 | 4/1970 | Hanson et al. | 221/11 |
| 3,648,889 | 3/1972 | Greaves et al. | 221/11 |
| 3,722,741 | 3/1973 | Mojden | 221/11 |
| 3,807,600 | 4/1974 | Moss et al. | 221/11 |

*Primary Examiner*—H. Grant Skaggs
*Attorney, Agent, or Firm*—Brumbaugh, Graves, Donohue & Raymond

[57] ABSTRACT

A drinking cup storage and feeding device for an automatic vending machine comprises a rotary type cup storage drum having a plurality of cup storage chambers around its periphery for receiving different kinds of drinking cups stacked in columns. A cup take-out stage has at least two cup take-out mechanisms spaced apart from each other and positioned adjacent to, but outside the rotational movement of the cup storage drum, for supplying specific cups one by one to a vending stage according to a selection signal. A switch detects when a cup take-out stage becomes empty of cups and then rotates the cup storage drum. A cup selecting mechanism detects when a full cup storage chamber storing a certain cup type reaches a position adjacent to the empty cup take-out stage for the same type of cup, during rotation of the cup storage drum, and stops rotation of the drum when the position is reached. A cup delivering mechanism delivers the full stored cup group column from the cup storage drum to the adjacent cup take-out stage for that cup type, while keeping the column in an upright stacked posture.

5 Claims, 12 Drawing Figures

DRINKING CUP STORAGE AND FEEDING DEVICE FOR AN AUTOMATIC VENDING MACHINE

BACKGROUND OF THE INVENTION

This invention relates to a drinking cup storage and feeding device, for use in an automatic vending machine which stores therein plural kinds of drinking cups, such as large-volume cups for use exclusively for cold drinks and small-volume cups for use exclusively for hot drinks, and which picks out a kind of cup according to a type of drink selected by a purchaser and feeds it toward a vending stage.

Recently, in order to provide different types of drink goods in a small vending machine installation area, machines have appeared which can serve both cold drinks and hot drinks. These machines effectively combine into one machine, a conventional cold drink vending machine using soda syrup, for example and a conventional hot drink vending machine using coffee or cocoa powder raw material, for example. In such a machine, since a delivered quantity of hot drinks differs from the delivery quantity of the cold drink, it has been necessary to store two different kinds of cups having different volumes, and to provide the proper cup to the vending stage according to a purchaser's selection.

To this end, a conventional type automatic vending machine has been equipped with two complete separate cup feeding devices for cold drinks and for hot drinks, respectively. However, depending on the particular season, the proportion of hot drinks sold varies remarkably from that of cold drinks, with a higher demand for the cold drinks in the summer season, and a higher demand for hot drinks in the winter season. Accordingly, it has been necessary to provide cup feeding devices for both hot drinks and cold drinks in a conventional machine with a large enough cup storage capacity for cold and hot drinks to satisfy the demands in both the summer and winter seasons. However, the turnover rate of hot drink cups in the summer season, and of cold drink cups in the winter season is very small due to the variation in the demand. Consequently, a conventional vending machine having two complete, independent cup feeding devices cannot be utilized effectively at the same time since one of the cup feeding devices is very poor in its working ratio and occupies a large space in the machine, while the other cup feeding device requires frequent cup replacement by an operator. If the separate cup storage capacity of each cup feeding device is enlarged, the space in the machine occupied by the cup feeding device would become very large and require enlargement of the cabinet, thus leading to place restrictions in vending machine installation areas.

SUMMARY OF THE INVENTION

In view of the above-mentioned circumstances, an object of this invention is to provide a drinking cup storage and feeding device for an automatic vending machine of a compact size and requiring less frequent filling of drinking cups by an operator, by enabling at least two different kinds of drinking cups to be stored in one cup feeding device, and so that a particular drinking cup can be delivered from a separately provided cup take-out port according to selection of goods. Further, a cup storage ratio of the two kinds of cups can be set through a simple operation, and at least two kinds of drinking cups can be dispensed with only one drinking cup storage and feeding device.

In accordance with this invention, the above-mentioned objects are accomplished by providing a drinking cup storage and feeding device comprising a cup storage drum of the rotary type, having on its periphery a plurality of cup storage chambers for receiving at least two different groups of drinking cups vertically stacked in columns, a cup take-out stage equipped with at least two classified-by-kind cup take-out mechanisms spaced apart each other and positioned outside the rotational movement of and adjacent to the cup storage drum, a cup selecting mechanism which detects when a stored cup group in the cup storage chamber reaches a position adjacent a cup taking-out stage for the same type of cup during rotation of the cup storage drum, and a cup delivering mechanism which delivers the stored cup group column from the cup storing drum to the cup take-out stage while keeping the column in an upright stacked posture, and which supplies a classified-by-kind cup group from the cup storage drum to a cup take-out mechanism.

BRIEF DESCRIPTION OF THE DRAWINGS

The invention will be better understood from the following description taken in connection with the accompanying drawings in which.

DETAILED DESCRIPTION OF THE PREFERRED EMBODIMENT

Figure 2:
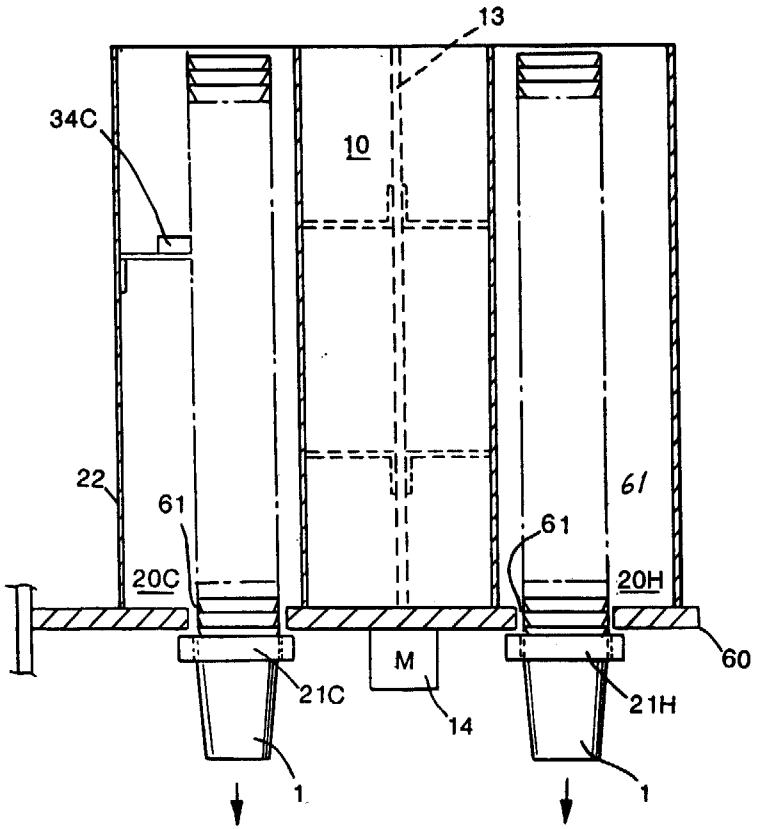
FIG. 2 is a sectional view taken substantially on the line II—II of FIG. 1.
Figure 1:
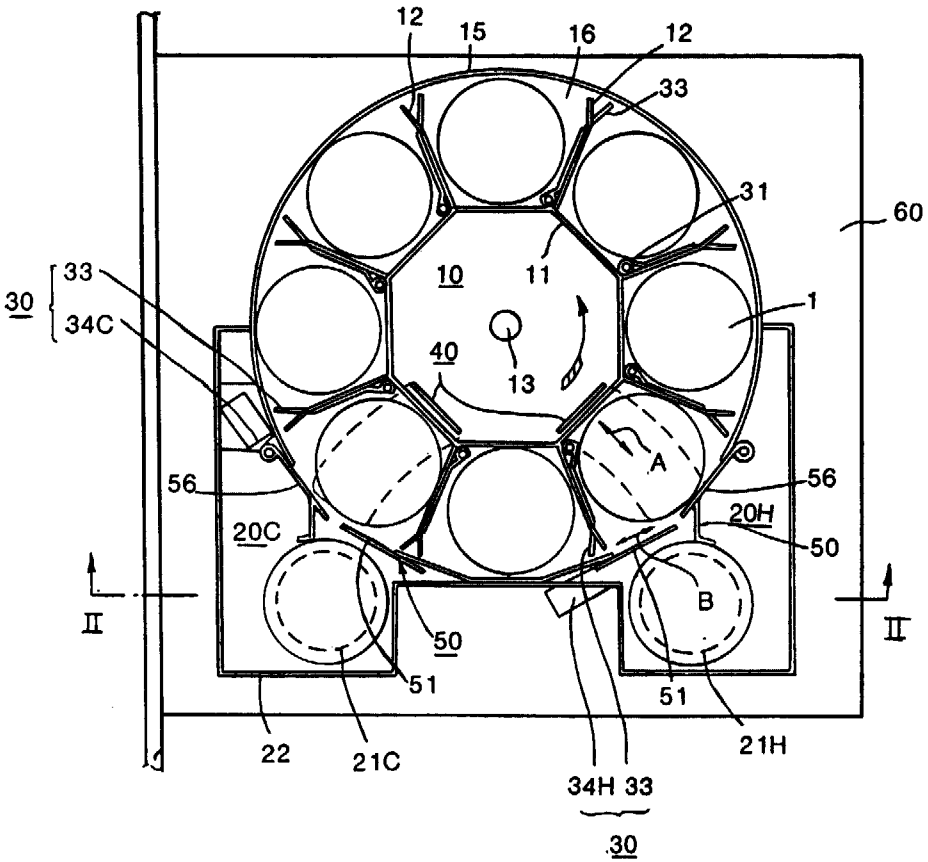
FIG. 1 is a plan view of an embodiment according to the invention.

With reference now to the drawings and more particularly to FIG. 1 and FIG. 2, a cup feeding device generally comprises a combination of a rotary type cup storage drum 10 on a driving vertical shaft, two sets of cup take-out stages 20C and 20H (suffix C indicating Cold and H indicating Hot, respectively) for cold drink cups and the hot drink cups equipped with take-out mechanisms, classified-by-kind cup selecting mechanisms 30, cup delivering mechanisms 40 corresponding to respective cup take-out stages, and gate mechanisms 50 arranged on a border between the cup storage drum 10 and the cup take-out stages 20C, 20H.

The cup storage drum 10 comprises a drum body including a polygonal inner cylinder 11 and partition plates 12 extending radially from each vertex of the inner cylinder, a rotating shaft 13 secured to the body, a drum driving motor 14 (see FIG. 2) coupled to the rotating shaft, and a fixed outer cover 15 enveloping a body outer peripheral surface, all of which are installed on a base plate 60. In cup storage chambers 16, partitioned by the partition plates 12 and standing on a peripheral circle, are stored at least two different kinds of drinking cups 1 stacked in columns. On an outer peripheral side deviating from a locus of rotation of the cup storage drum 10, are formed two sets of the cup take-out stages 20C and 20H parted to both right and left sides of the base plate 60. Cup take-out holes or ports 61 are formed by the base plate 60 below the cup take-out mechanisms 21C, 21H, and an external wall 22 surrounds the cup take-out stages 20C, 20H. Cup take-out mechanisms 21C, 21H provide means which pull down and deliver one bottom cup at a time from vertically-columned cup groups by means of driving motor in response to a selling instruction. The cup take-out mechanisms 21C, 21H include cup size adjusting mechanisms and sold-out detection switches to detect when all the cups in the column are sold out.

Figure 3:
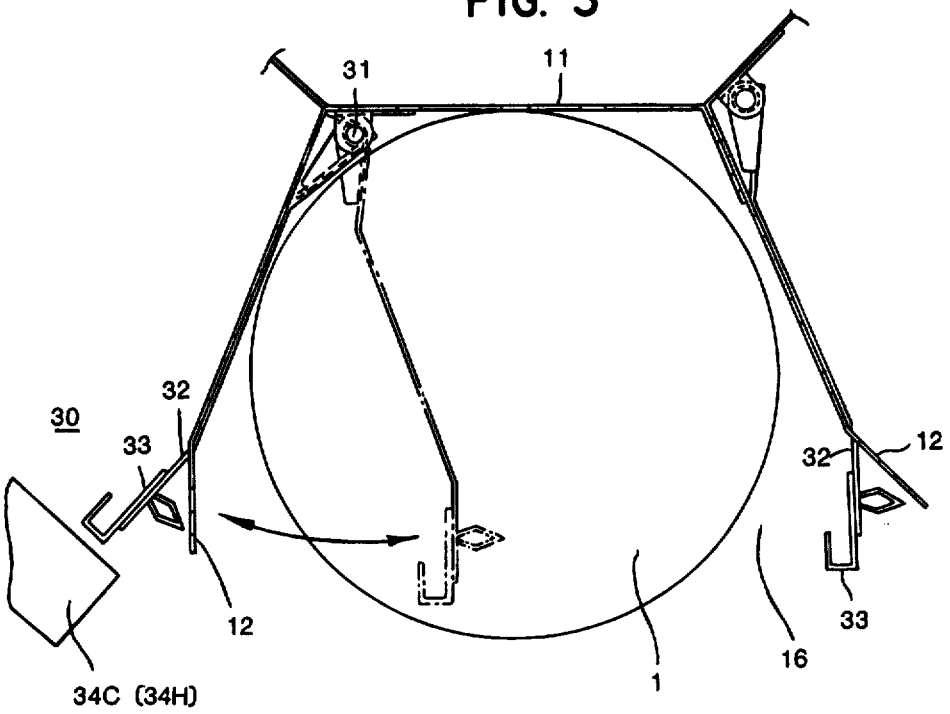
FIG. 3 is enlarged plan view of the selecting mechanism portion.
Figure 4:
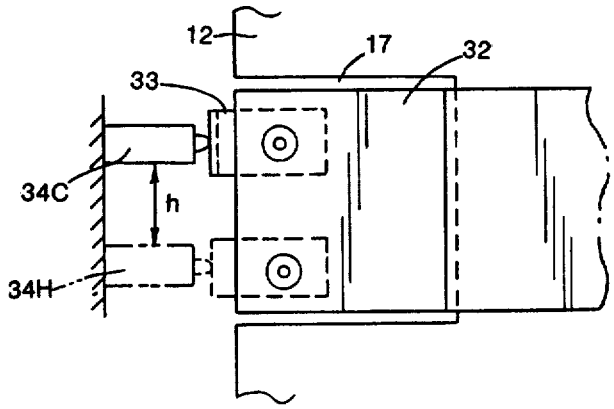
FIG. 4 is a side view of part of the selecting mechanism portion.

As shown in FIG. 3 and FIG. 4, the cup selecting mechanism 30 comprises in combination a swing type detecting lever 32 supported through a supported pin 31 to a rear wall on each cup storage chamber 16, an actuator 33 mounted to the end of the swing type detecting lever in such a way that its mounted height can be adjusted for use for either small or large cups, and cup detecting switches 34C, 34H mounted at positions corresponding to possible positions of actuator 33 with their mounted heights deviating from each other by the distance h as shown in FIG. 4. The swing type detecting lever 32 is spring biases toward the cup 1 stored in the cup storage chamber 16, and will move to the position of the dashed line of FIG. 3, of the cup storage chamber 16 is empty, but will stretch out to the position of the solid line if at least one cup 1 is stored therein. The height of the actuator 33 should be set to the height of cup detecting switch 34C or 34H, depending on the type of stored cups placed in that cup storage chamber. It should be understood that all of the cups in a particular storage chamber should be the same size or type.

To avoid interference of the swing lever 32 with the partition plate 12 of the cup storage drum, a notch 17 is formed in the partition plate 12 as shown in FIG. 4. Therefore, if the cup groups are stored in the cup storage chamber 16 during a slow-speed rotation process of the cup detecting switch 34C or 34H at the time that the cup storage chamber reaches the position confronting the cup take-out stage 20C or 20H corresponding thereto.

Referring now to FIGS. 5–8, the cup delivering mechanism 40 and the gate mechanism 50 shown in FIG. 1 will now be described in greater detail. The cup delivering mechanism 40 is designed for delivering, in a pushing manner, the particular cup group stored in the cup storage chamber toward the cup take-out stage, only if the cup storage drum 10 is stopped in place. The cup delivering mechanism 40 is designed to operate, in a reciprocating manner, an L-shaped pusher 41 by means of driving portion 70. The driving portion 70 delivers a cup group toward the cup take-out stage by sliding the group on the base plate while keeping its vertical upright posture. The driving portion 70 comprises a driving motor 71, which drives a driving arm 72 through a driving motor shaft 77, and a swing lever 74 supporting the pusher 41 which engages with a tip pin 73 of the arm 72. The swing lever 74 is swingingly supported about a fulcrum pin 75, and the tip pin 73 is engaged in a slot 76. When the motor 71 drives the driving arm 72 in this state, the swing lever 74 reciprocates swingingly between the solid line and the dashed line as shown by the arrow A in FIG. 5 during one revolution of the driving arm 72, so that the pusher 41 delivers, in a pushing manner, the cup group stored in the cup storage chamber toward the cup take-out stage.

A side gate door 51 of the above-mentioned gate mechanism 50 is interconnected to the swing lever 74 through a link 52, and a supporting shaft 53 of the gate door 51 fits into and is guided by a slot 55 made on a bed frame 54. Consequently, the gate door 51 functions to open and close in the direction of the arrow B accompanied by the swing motion of said swing lever 74. The gate door 51 situates normally in a closing position to project between the cup storage drum and the cup take-out stage in order to prevent a columned cup group from falling down, and temporarily opens by interlocking with the pusher 41 only when the cup group stored in the drum is delivered to the cup take-out stage. Naturally, the driving motor 71 may be directly coupled to the driving arm 72 in the above-mentioned driving mechanism 70. In the embodiment shown in the figures, a clutch mechanism 80 described further below is interposed between the driving motor 71 and the driving arm 72 to permit engagement and disengagement of the two. By interposing the clutch mechanism 80 between them, it is possible to adapt one driving motor to a power supply for both the cup delivering mechanism and said cup take-out mechanism.

Figure 6:
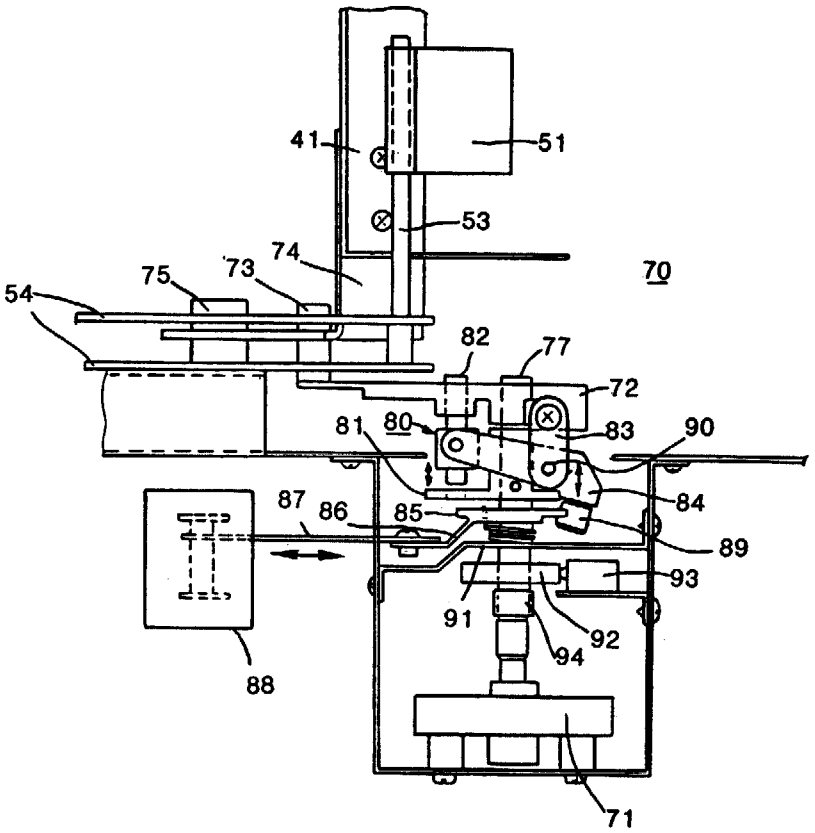
FIG. 5 and FIG. 6 are, respectively, a plan view and a side view of the cup delivering mechanism portion.
Figure 5:
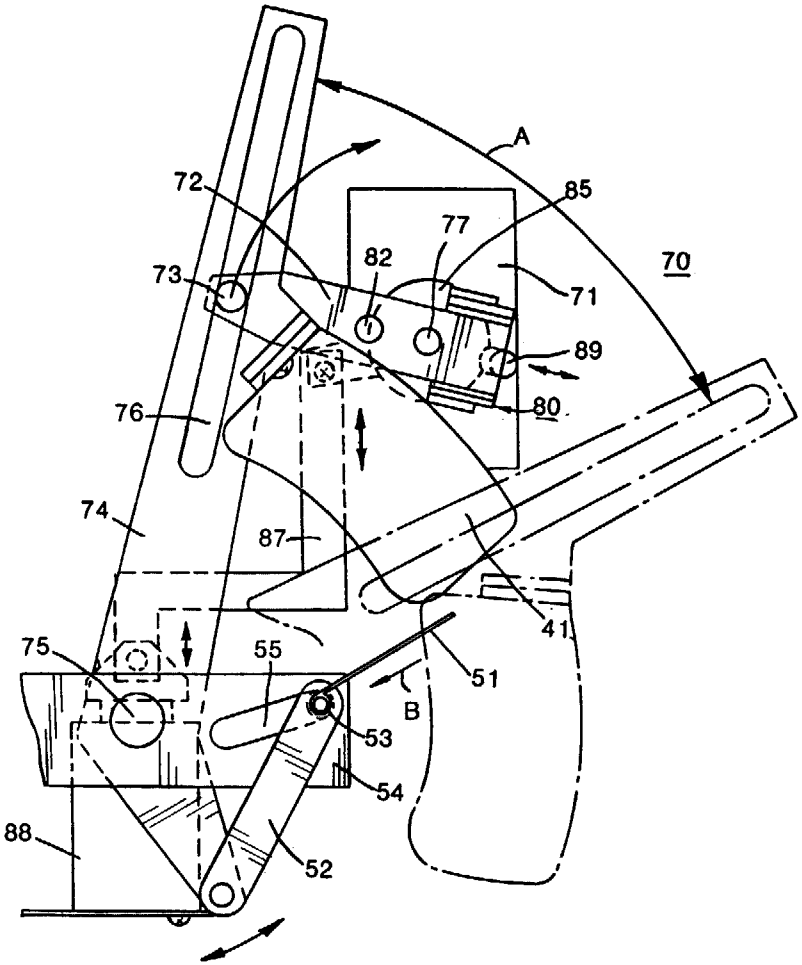
Figure 7A:
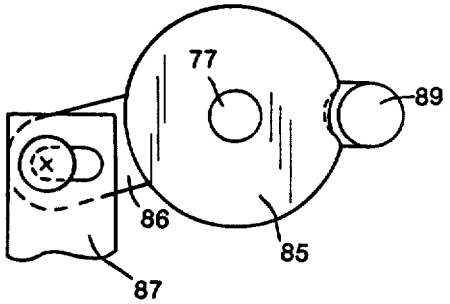
FIGS. 7(*a*) and (*b*) and FIGS. 8(*a*) and (*b*) are plan views and side views showing different functioning situations of the clutch mechanism in FIG. 6 respectively.
Figure 8A:
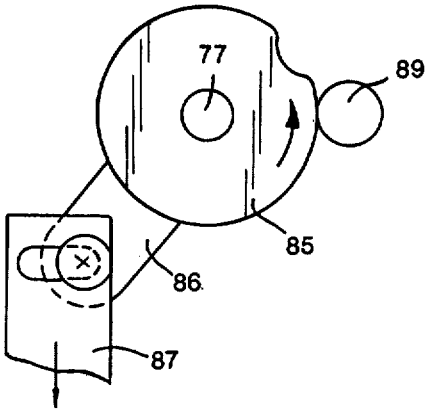
Figure 7B:
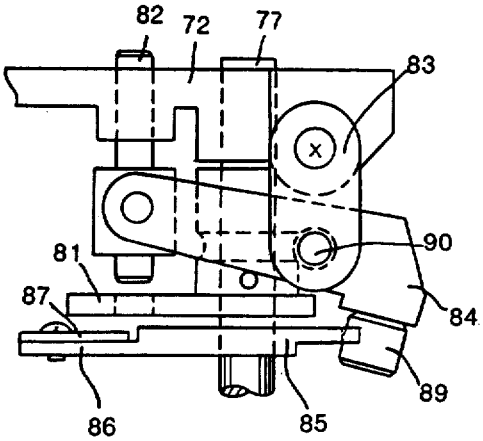
Figure 8B:
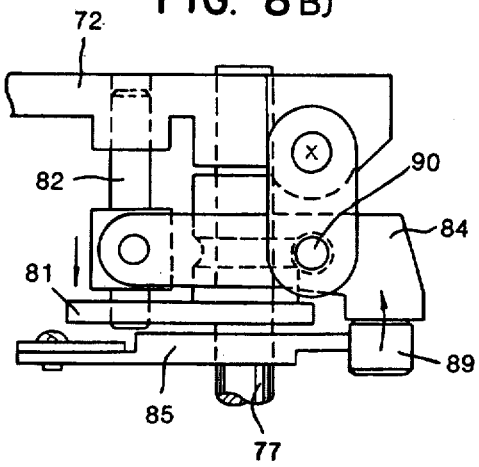

Referring now to FIG. 6, FIG. 7, and FIG. 8, the clutch mechanism 80 will now be described in greater detail. The clutch mechanism 80 comprises a vertically movable slide shaft 82 which couples the driving arm 72 to a rotary plate 81 securely fixed to the motor shaft in parallel with the driving arm 72 together by being fitted into aligned shaft holes provided on both the driving arm 72 and the rotary plate 81. The clutch mechanism also comprises a control lever 84 connected to the slide shaft 82 and supported by the driving arm 72 through a supporting lever 83, a disk cam 85 movably fitted to the motor shaft and which swingingly operates control lever 84, and an electromagnetic solenoid 88 connected to an arm 86 of the disk cam 85 through a link 87. A roller 89 is set to the control lever 84 facing to the disk cam 85, and the control lever 84 is connected swingingly to the supporting lever 83 by means of a pin 90. FIG. 6 shows a return spring 91 of the disk cam 85, a cam 92 secured onto the motor shaft and confronting a switch 93 for detecting rotational position of the motor shaft 77, and a driving lever 94 interconnected to the cup take-out mechanism shown in FIG. 2.

The clutch mechanism 80 as described above functions in the following manner. Under a normal waiting condition as shown in FIGS. 7(*a*) and (*b*), a roller 89 falls into a recession formed in the periphery of the disk cam 85, the control lever 84 assumes a position so as to swing clockwise about the pin 90, and the slide shaft 82 is lifted upward away from the shaft 77 to disconnect the driving arm 72 from the driving motor 71. However, when the solenoid receives a functioning signal to cause a withdrawal movement as shown in FIGS. 8(*a*) and (*b*), the disk cam 85 rotates slightly, in the direction of the arrow, through the link 87 to push the roller 89 out of the recession of the disk cam. Therefore, the swing lever 84 swings counterclockwise about the pin 90 to pull the slide shaft 82 downwardly. If the motor 71 starts in this condition, the slide shaft 82 will be fitted into the shaft hole of the rotary plate 81 when the shaft hole of the rotary plate 81 coincides with the slide shaft 82, and the clutch will be engaged. Thus, the rotation of the motor 71 is transmitted through the rotary plate 81 and the slide shaft 82 to the driving arm 72, and the swing lever 74 is swingingly operated to actuate the pusher 41 and the gate door 51 as described above in the discussion of FIG. 5. It should be understood that the above-mentioned clutch mechanism 80 and the driving mechanism of the pusher and the gate door 51 represent only one embodiment of this invention, and other mechanisms may be alternatively employed.

Figure 9A:
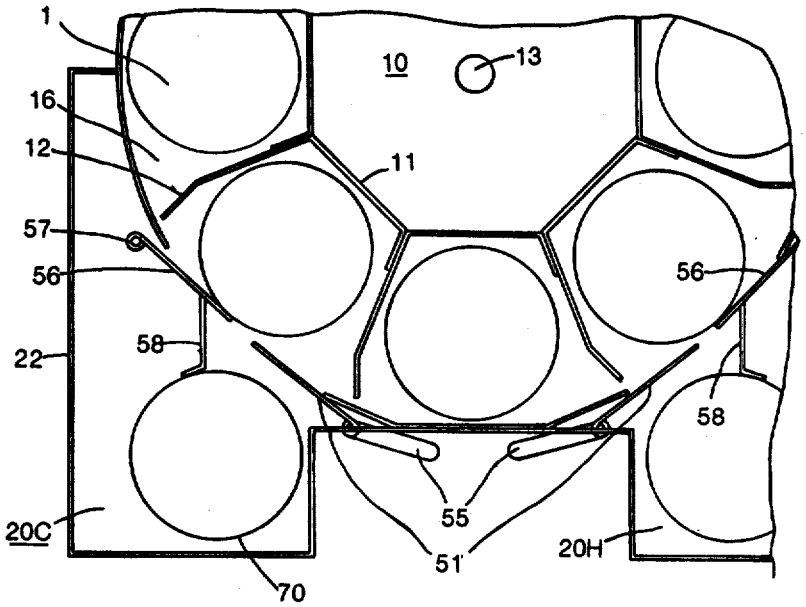
FIGS. 9(*a*) and (*b*) are views showing opened and closed positions of the gate mechanism, respectively.
Figure 9B:
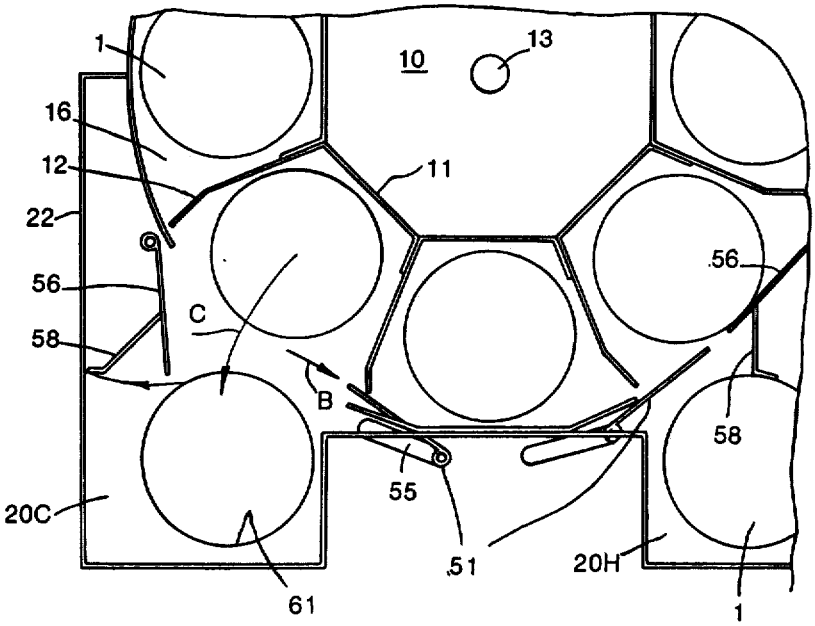

As best seen in FIGS. 9(*a*) and (*b*), the gate mechanism 50 comprises a combination of a pair of gate doors 51 and 56 in a flap-like arrangement. Both gate doors 51 and 56 are arranged on the border between the cup storage drum 10 and the cup take-out stages 20C, 20H in line. The gate door 51 is opened and closed by the motor by being interlocked with the cup delivering mechanism as described above. The other gate door 56 is swingingly supported about the pin 57 and normally forced to the closing position by means of a spring not shown in the figure. Further, the gate door 56 has a cup holding tong 58 branching like a spring from a middle portion thereof.

When cups 1 are stocked in the cup take-out stage as shown in FIG. 9(*a*), the gate doors 51, 56 are closed to prevent the columned cup group from accidentally falling down. When the cup take-out stage 20C becomes empty and the columned cup group is pushed forth, as shown by the arrow C, from the cup storage drum 10 toward the cup take-out stage 20C by means of the cup delivering mechanism, (not shown in FIG. 9(*b*)), the gate door 51 moves back to open a cup supply passage and the other gate door 56 begins to open by being pushed with the cup group. When the cup group slips through the gate door 56, the gate door 56 is closed by the spring force while the cup holding tong 58 turns to a position behind the cup group. Accordingly, the cup group cannot come back toward the cup storage drum together with the pusher during the return process of the pusher of the cup delivering mechanism, and the cup group is correctly positioned in the cup take-out stage and set to the cup take-out mechanism.

The overall cup feeding operation will now be described. First of all, a proportional number of columns of cold drink and hot drink cups should be stored in storage chambers 16, determined by considering both the entire capacity of the cup storage drum 10 and the relative demands of cold drinks and hot drinks depending on the season. For the chambers 16 storing the columns of cold drink cups, the associated actuators 33 of the cup selecting mechanisms 30 should be set by adjusting its height to correspond to that of the cold drink cup detecting switch 34C, and for the chambers 16 storing the hot drink cups, the respective actuators of the cup selecting mechanisms should be set by adjusting its height to that of the hot drink cup selecting switch 34H. Sequential control is executed in such a way that, when a stock of cups in a cup take-out mechanism 21C or 21H becomes empty, a cup soldout switch functions to send a signal to the drum driving motor 14 and causes revolution of the cup storage drum 10. When a cup detecting switch for the empty cup take-out mechanism is actuated by the actuator of the cup selecting mechanism during revolution of the drum, this condition, in cooperation with the actuation of the sold-out switch of the respective empty cup take-out mechanism, gives the drum driving motor 14 a stop-signal. A control circuit is designed so that at the same time a signal is given to actuate the solenoid of the cup delivering mechanism, the driving motor 71 will start upon the next selling instruction, the selected cup take-out mechanism operates according to the indicated selection, and a proper size cup is delivered from the respective cup take-out stage to the vending stage.

According to the above-described construction, the feeding device operates as follows. The cup storage drum 10 revolves when either of the cup take-out stages 20C, 20H becomes empty. The drum then stops when a cup storage chamber 16, which stores a cup group of a kind corresponding to an empty cup take-out stage, just reaches the position facing the cup take-out stage. The cup delivering mechanism 40 then starts operation together with the operation of the cup take-out mechanism upon the next selling instruction, and a columned cup group stored on the cup storage chamber is delivered to the empty cup take-out stage as a column. When the column cup group just delivered to the cup take-out stage is correctly set to the cup take-out mechanism, and when the cup delivering mechanism and gate mechanism return to their original positions, the cup supply operation is completed and the device again returns to its normal waiting condition. Since the swing type detecting lever 32 belonging to the empty storage chamber has been retracted back to the position of the dashed line of FIG. 3, this empty storage chamber can revolve in the drum 10 without actuating a cup detecting switch.

As seen from the foregoing description, according to the present invention plural kinds of drinking cups can be stored and disposed of by utilizing only one drinking cup feeding device, thus minimizing the space in an automatic vending machine occupied by the cup feeding device. With respect to the plural cup storage chambers in the cup storage drum 10, the proportion of cups stored in the chambers can be changed as desired depending on seasonal demands, because cup groups stored in the drum can be selected at each chamber by choosing the setting position of the actuator for the cup selecting mechanism. Moreover, setting of these stored cup groups according to the kinds of cups can be done at random, i.e. the chambers storing one kind of cup need not be adjacent to each other. For this reason, a machine having limited cup storage capacity can utilize to the maximum efficiency, and cups can be replaced by an operator less frequently. Furthermore, according to this invention it is possible to provide a drinking cup feeding device superior in construction and function, which can select plural kinds of stored cups and supply them to the cup take-out mechanism of the cup take-out stage smoothly, by providing the cup-take out stage to confront the cup storage drum outside the locus of the drum revolution, and by providing the particular cup selecting mechanism and the cup delivering mechanism.

From the foregoing, it will be observed that numerous variations and modifications may be effected without departing from the true spirit and scope of the novel spirit of the invention. It is to be understood that no limitation with respect to the specific apparatus illustrated here is intended or should be inferred. It is, of course, intended to cover by the appended claims all such modifications as fall within the scope of the claims.

We claim:

1. A drinking cup storage and feeding device for an automatic vending machine comprising:

a rotary type cup storage drum having on its periphery a plurality of cup storage chambers for receiving at least two different kinds of drinking cups stacked in columns;

a cup take-out stage having at least two classified-by-kind cup take-out mechanisms spaced apart from each other and positioned adjacent to, but outside the rotational movement of the cup storage drum, for supplying specific cups one by one to a vending stage according to a selection signal;

means for sensing when a cup take-out stage becomes empty of cups, and for rotating the cup storage drum in response to said empty condition;

cup selecting means for detecting when a full cup storage chamber storing a certain cup type reaches a position adjacent an empty cup take-out stage for the same type of cup during rotation of the cup storage drum, and for stopping rotation of the drum in response thereto; and cup delivering means for delivering the full stored cup group column from the cup storage drum to the adjacent cup take-out stage for that cup type while keeping the column in an upright stacked posture.

2. A drinking cup storage and feeding device as set forth in claim 1, wherein the cup selecting means comprises a cup selecting mechanism having two different cup detecting switches positioned at different heights at the adjacent cup take-out stages, and an actuator associated with each chamber, positioned to confront the cup detecting switches, and wherein said actuators are selectively adjustable to different mounting heights to actuate the respective cup detecting switch corresponding to the type of cups stored in the particular chamber.

3. A drinking cup storage and feeding device as set forth in claim 2, further including a swing type detecting lever on a side wall of each storage chamber, and wherein each actuator is mounted at a tip end of a different lever, and wherein said detecting lever is spring forced toward the inside of the storage chamber about a supporting point, whereby the actuator will retract and be prevented from actuating a cup detecting switch when the chamber is empty.

4. A drinking cup storage and feeding device as set forth in claim 1, wherein the cup delivering means comprises a cup delivering mechanism having a motor driven pusher element for pushing a columned cup group from a cup storage chamber to a cup take-out stage.

5. A drinking cup storage and feeding device as set forth in claim 1, including a gate mechanism having a gate which maintains a stored column cup group upright but which opens when the cup group is delivered to the cup take-out stage.

* * * * *